United States Patent [19]

Parker et al.

[11] 4,380,892

[45] Apr. 26, 1983

[54] FRICTION SPINNING APPARATUS AND METHOD FOR CLEANING

[76] Inventors: Alan Parker, 7 Darvel Close, Breightmet, Bolton, Lancashire; Peter J. Dickinson, 30 Narcissus Ave., Helmshore, Rossendale, Lancashire; Douglas O. Clough, 26 Parkwood Dr., Rawtenstall, Rossendale, Lancashire; William M. Farnhill, Burnley, all of England

[21] Appl. No.: 301,917

[22] Filed: Sep. 14, 1981

[30] Foreign Application Priority Data

Oct. 8, 1980 [GB] United Kingdom ..... 8032418

[51] Int. Cl.[3] ..... D01H 7/885

[52] U.S. Cl. ..... 57/401; 57/263; 57/301

[58] Field of Search ..... 57/401, 403, 263, 301, 57/302, 304

[56] References Cited

U.S. PATENT DOCUMENTS

| | | | |
|---|---|---|---|
| 4,168,601 | 9/1979 | Didek et al. | 57/401 |
| 4,202,163 | 5/1980 | Turk et al. | 57/401 |
| 4,315,398 | 2/1982 | Parker et al. | 57/401 |

FOREIGN PATENT DOCUMENTS

| | | | |
|---|---|---|---|
| 2042599 | 9/1980 | United Kingdom | 57/401 |

*Primary Examiner*—John Petrakes

*Attorney, Agent, or Firm*—Donald H. Feldman

[57] ABSTRACT

The yarn formation area of a friction spinning apparatus, in which the rotating friction rollers and the feed duct lie closely adjacent, is quickly and simply cleaned of remaining fibres at a yarn break and protection is provided against damage caused by excess fibres entering the area. One of the rollers, which is imperforate, is mounted for pivotal movement away from the area and at a break suction through the other roller is temporarily closed off from one end of the area toward the opposite end to eject the remaining fibres. Return movement of the roller is guided to ensure proper return to the operating position.

13 Claims, 5 Drawing Figures

FIG.1.
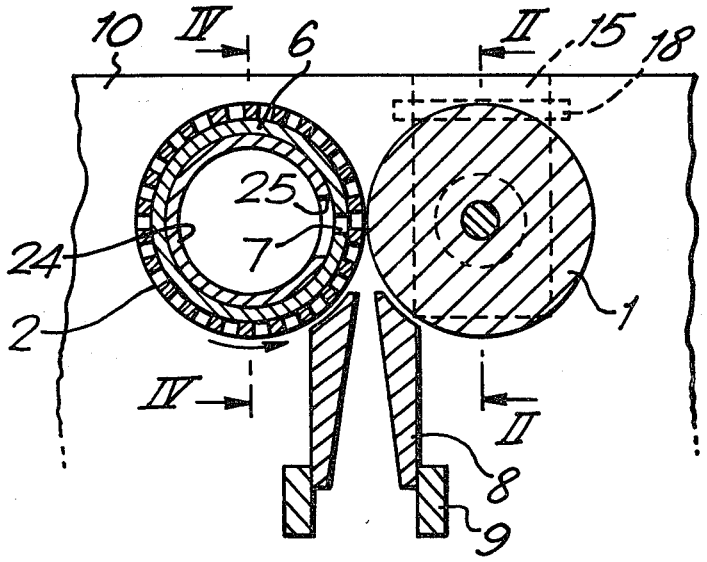
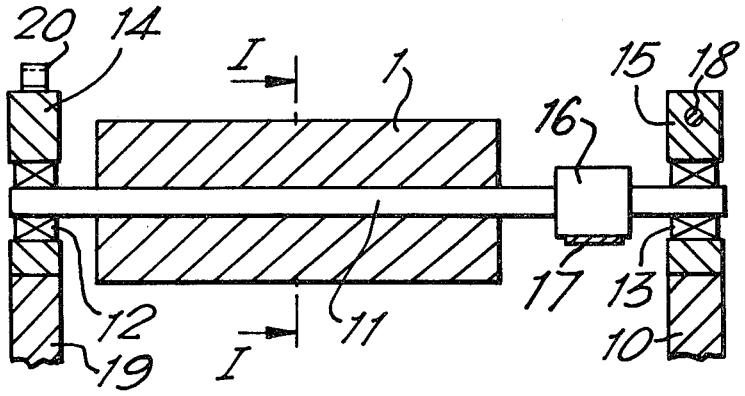
FIG.2.

FIG.3.
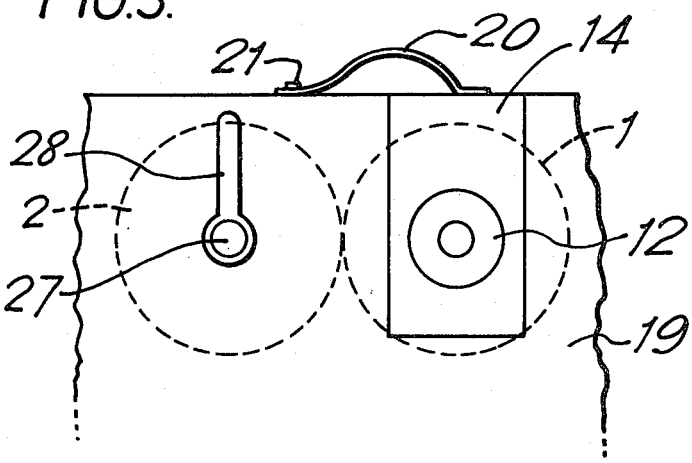
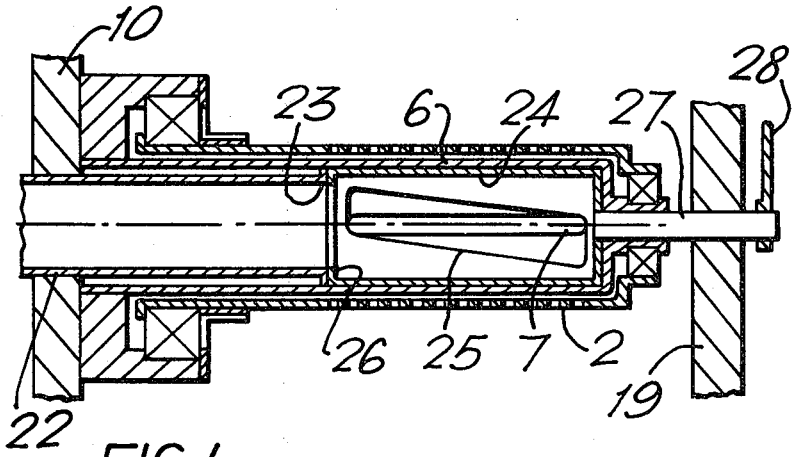
FIG.4.
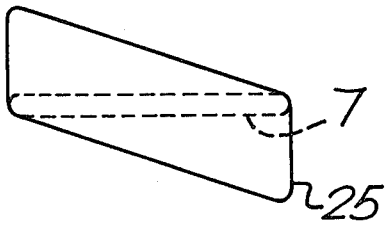
FIG.5.

FRICTION SPINNING APPARATUS AND METHOD FOR CLEANING

FIELD OF THE INVENTION

This invention relates to apparatus for the open-end spinning of yarn and particularly to apparatus of the kind known as friction spinning. Apparatus of this kind comprises two bodies of rotation each defining a surface and arranged such that the surfaces are closely adjacent at a line of closest approach so as to define between them at that line a yarn formation area, a fibre feed duct for feeding fibres into the yarn formation area which feed duct terminates closely adjacent the surfaces, means for rotating each of the bodies about a respective axis so as to twist the fibres in the area into a yarn, and means for withdrawing the yarn from the area.

BACKGROUND OF THE INVENTION

Apparatus of this kind has been disclosed in published British application No. 2 042 599 of Platt Saco Lowell and similar apparatus has been disclosed in various patents and patent applications by Barmag Barmer Maschinenfabrik AG, Dr. Ernst Fehrer and Vyzkumny Ustav Bavlnarsky. None of these apparatus has yet reached fully successful commercial exploitation. Neither Barmag nor Fehrer have concerned themselves with the problems of fibres remaining in the yarn formation area at an end break, possibly because they have not in their apparatus had the small tolerances and gaps necessary in this area to achieve optimum spinning performance and to reduce air losses. Vyzkumny in their U.S. Pat. No. 4,168,601 disclose an arrangement which also does not have the necessary small gaps and tolerances; but in this arrangement an inner cylindrical roller can be moved axially away from co-operation with the inner surface of an outer roller to allow cleaning of any material remaining in the spinning area at a stoppage and to perform the piecing up function. In this apparatus the spinning area is very large in comparison with the diameter of a yarn and hence there is no need for consideration of problems concerning excess material in that area during operation. The provisions for cleaning this form of apparatus would therefore be adequate to allow proper cleaning of the area although the structure is extremely cumbersome and therefore time consuming and also expensive to manufacture. It is also necessary to stop the motion of the surfaces.

In published British application No. 2 042 599 (particularly in FIG. 2) it is disclosed that one of the bodies can be moved away from the other and from the fibre feed duct, but this is only for purposes of adjustment of the small gaps between these parts for optimisation of the spinning conditions. Careful setting of the gap is necessary for any movement of the movable body in view of the very small tolerances necessary and when set the bodies and the feed duct are for all other purposes fixed.

SUMMARY OF THE INVENTION

It is an intention of the present invention to provide an open-end spinning apparatus of this kind wherein cleaning of any remaining fibres following a yarn break from the spinning area can be effected simply, quickly and without undue mechanical complication, and wherein any excess fibre material collecting in the spinning area does not cause damage. It is also an intention to provide methods of cleaning, following an end break, open-end spinning apparatus of this kind, which are simple quick and effective.

Accordingly the present invention is characterized in that there are provided means mounting the two bodies and the feed duct such that relative movement is provided between the feed duct and one of the bodies away from and back to the operating position in a direction transverse to the line and to increase and decrease respectively the spacing therebetween and means for defining the operating position such that the return to the operating position is made without the need for resetting.

Additionally the invention provides a method of cleaning following a yarn break an apparatus for open-end spinning of yarn of the type comprising two bodies of rotation each defining a surface and arranged such that in an operating position the surfaces are closely adjacent at a line of closest approach so as to define between them at that line a yarn formation area, suction means for developing an air stream through at least one of the surfaces at the yarn formation area, a fibre feed duct for feeding fibres into the yarn formation area which feed duct terminates in the operating position closely adjacent the surfaces, the method being characterized in the steps of causing relative movement between at least one of the bodies and the duct in a direction transverse to the line and to increase the spacing therebetween, and temporarily halting the airstream through the surface.

Furthermore the invention provides a further method of cleaning following a yarn break an apparatus for open-end spinning of yarn comprising a body having a perforated surface, means defining an elongate yarn formation area on the surface, suction means for developing an air stream through the surface at the yarn formation area, and a fibre feed duct for feeding fibres on to the yarn formation area, the method being characterized in that the airstream through the surface is gradually closed off from one end of the area toward the opposite end whereby to move any fibres remaining on the area toward the opposite end for ejection from the area.

BRIEF DESCRIPTION OF THE DRAWINGS

FIG. 1 is a cross-sectional view (along the line I—I in FIG. 2) showing schematically the rollers and feed duct of a friction spinning apparatus according to the invention;

FIG. 2 is a cross-sectional view along the line II—II of FIG. 1 omitting the feed duct and mounting arrangements for the roller 2;

FIG. 3 is a view of the left hand end of FIG. 2;

FIG. 4 is a cross-sectional view similar to FIG. 2 along the lines IV—IV of FIG. 1; and FIG. 5 is straightened out view of the slot 25 in the inner sleeve 24 of FIGS. 1 and 4.

DESCRIPTION OF THE PREFERRED EMBODIMENT

Reference should be made to published British Patent Application No. 2 042 599 which discloses the structure and function of apparatus of this kind and the present description will for the most part concern those areas where the apparatus has been modified in accordance with the present invention.

The apparatus comprises a pair of cylindrical rollers 1 and 2 rotating in the direction shown by the arrows and arranged closely adjacent at a line of closest approach. The roller 1 is imperforate and comprises a solid metal roller. The roller 2 is perforated over the majority of its peripheral surface and has a duct 6 closely adjacent the inside surface with an elongate slot 7 which extends substantially fully along the roller 1 at or adjacent the line of closest approach.

Turning briefly to FIG. 4, the mounting and bearing arrangements are substantially as shown and fully described in the published application, as is the duct 6 (shown at 13 in the published application). A further duct 22 communicates suction from a suction source not shown with the duct 6 and terminates at an end collar 23 adjacent the perforated portion of the roller 1. An inner sleeve 24 coaxial with the roller 2 and duct 6 is arranged to have its peripheral surface closely adjacent the inner surface of the duct 6 to prevent leakages of air and has a slot 25 having the shape of a parallelogram as shown in FIG. 5, the purpose of which will be explained hereinafter. The sleeve 24 terminates at one end in a collar 26, for co-operation with the collar 23 to allow rotation of the sleeve 24 but to prevent axial movement, and at the other end in a shaft 27 which extends through a bore in the end of the duct 6 and which carries a manually operable lever 28 whereby the sleeve 24 can be rotated inside the duct 6.

A feed duct 8 is fixedly mounted on a portion of machine frame-work 9 shown only schematically; the details of the feed duct are more fully described in co-pending application Ser. No. 308,955, filed Oct. 6, 1981. It suffices to say here that the gaps between the rollers and between the rollers and the feed duct are kept small and the feed duct projects well in between the rollers toward the line of closest approach so that a small confined zone or yarn formation area is formed.

In this area fibres are fed from the feed duct and are twisted into yarn by the rotating of the rollers as disclosed in detail in the published application.

The roller 2 is mounted via the suction duct 6 on a machine frame member 10 substantially as shown in FIG. 1 of the published application No. 2 042 599 such that it is rigidly supported by the member 10 which in turn is rigidly connected to the frame member 9. Thus the feed duct 8 and roller 2 are fixed in relation to one another.

The roller 1 is mounted on a shaft 11 carried in bearings 12, 13 in turn supported in metal support plates 14, 15 such that the roller 1 is free to rotate in the plates 14, 15 but is rigidly supported thereby. The shaft carries a drive pulley 16 co-operating with a belt 17 which drives the roller and also drives the roller 2 by means not shown.

The plate 15 is a close fit within an opening cut in the frame member 10 and is carried on a pivot 18 rigidly fixed thereto. The plate 14 is similarly a close sliding fit within an opening in a further frame member 19 so that when in position in the frame member 19 it locates the roller 1 accurately relative to the feed duct 8 and the roller 2, in accordance with settings applied previously or during manufacture. A leaf spring 20 fixed to the frame member 19 by a screw 21 applies spring bias to the plate 14 so as to tend to maintain it in its position in the frame member 19. The spring is designed to apply only sufficient force to counteract the turning moment generated by pressure from the belt 17.

In use, under normal spinning conditions, the plate 14 remains in position in the frame member 19 and hence the settings between the rollers 1 and 2 and the feed duct 8 are maintained. However on an end break or any other fault occuring whereby an excessive amount of fibres enters the confined space defining the yarn formation area, the pressure developed by the excess fibres, tends to lift the roller 1 away from the feed duct by pivotting movement about the pivot 18 thus avoiding excessive force on the rollers and feed duct and possible resultant damage.

The axis of the pivot 18 lies in a plane parallel to one containing the axes of the rollers 1 and 2 and hence movement of the roller 1 is perpendicular to that plane.

It will be noted that the roller 2 tends to move any excess material away from the feed duct whereas the roller 1 tends to move it into the narrow gap between the feed duct and the roller. Hence movement only of the roller 1 is sufficient to prevent excess material causing damage. Additionally movement only of the roller 1 is more simply achieved because it does not have the complexity of mounting and suction connections necessary for the roller 2 (as shown in FIG. 4). However in an alternative arrangement motion of both of the rollers in this direction could be provided preferably by a pivoting arrangement.

Following the end break or fault it will be necessary to restart spinning and this necessitates cleaning of the yarn formation area to remove any remaining material. In practice after an end break a highly twisted mass of fibres is left along the spinning zone. This can be achieved simply and quickly and without disconnecting the drives to the rollers by the operative firstly moving the end of the roller 1 and the plate 14 upwardly against the spring bias on the pivot 18.

Secondly the lever 28 is manually turned anti-clockwise to rotate the inner sleeve 24 in the same direction. This causes the lower surface of the slot 25 to move upwardly to gradually close off the slot 7 from the end at the back of the unit adjacent the drive belt 17 forwardly to the front end of the slot so that the remaining elongate mass of fibres is drawn forwards by the remaining airflow through the open part of the slot along the slot and eventually ejected from the spinning area after the slot is fully closed. In practice, the mass falls from the spinning area through the space left between the feed duct 8 and the roller 1 after it has been lifted and can be caught beneath the spinning unit on a catch-tray (not shown) for later cleaning. The closing off of the slot 7 is carried out gradually from the back to carry the fibre mass away from the influence of the suction applied to the feed duct (not shown in these drawings but disclosed in the published application) and to assist in causing one end to fall from the feed duct thus releasing the whole of the mass. It is however possible in other embodiments merely to close off the length of the slot 7 simultaneously, preferably in a direction away from the feed duct 8, whereby the mass is ejected mainly by the effect of the ongoing rotation of the roller 2.

On release of the roller 1 and plate 14 by the operative it will return to its proper position guided by the sliding of the plate 14 in the frame member 19. In this way the plate 14 and frame member 19 define the return position for the roller 1 and the settings of the rollers and feed duct are maintained without need for further adjustment or resetting, until replacement of a roller is necessary. The lever 27 is finally returned to the initial position to reopen the slot 7 and recommence the airstream through the surface.

For a yarn piecing cycle substantially as disclosed in our European Application No. 0034427 (published on Aug. 26, 1981), the lever 28 can be moved also in a clockwise direction so that the upper surface of the slot 25 acts to close off the slot 7 from the front toward the back.

The invention can be applied also to apparatus including two perforated rollers by closing off the suction jointly at a point further upstream and by moving one or both of the rollers relative to the feed duct. Alternatively the feed duct can be moved away from fixed rollers.

We claim:

1. Apparatus for open end spinning of yarn, comprising two bodies of rotation each defining a surface and arranged such that in an operating position the surfaces are closely adjacent at a line of closest approach so as to define between them at that line a yarn formation area, a fibre feed duct for feeding fibres into the yarn formation area which feed duct terminates in the operating position closely adjacent the surfaces, means mounting the two bodies and the feed duct such that relative movement is provided between the feed duct and one of the bodies away from and back to the operating position in a direction transverse to the line and to increase and decrease respectively the spacing therebetween and means for defining the operating position such that the return to the operating position is made without the need for resetting.

2. Apparatus according to claim 1, including a framework, means mounting the feed duct in stationary position relative to the framework and means mounting one of the bodies for movement relative to the framework and the feed duct.

3. Apparatus according to claim 2, wherein there are provided means mounting the other of the bodies in stationary position relative to the framework.

4. Apparatus according to claim 3, in which the movable body rotates in a direction such that its surface moves from the line toward the feed duct and the stationary body rotates such that its surface moves from the feed duct toward the line.

5. Apparatus according to claim 3, in which the surface of the movable body is imperforate and the surface of the stationary body is perforated and there are provided suction means for developing an airstream therethrough.

6. Apparatus according to claim 2, wherein the means mounting the body includes a pivot at or adjacent one end of the body whereby the body is pivotable about an axis transverse to the line.

7. Apparatus according to claim 1, including guide means for guiding the relative movement back to the operating position.

8. Apparatus according to claim 1, wherein the bodies are cylindrical and rotatable about parallel axes and wherein said relative movement is perpendicular to the plane including the axes of rotation of the bodies.

9. Apparatus according to claim 1, including biasing means to act against said relative movement whereby said relative movement can occur against said bias in response to pressure developed by excess fibre material between the bodies and the feed duct.

10. Apparatus according to claim 1, wherein at least one of the bodies is perforated and there are provided suction means for developing an airstream through the body, and there are provided means for temporarily halting the airstream.

11. A method of cleaning following a yarn break an apparatus for open-end spinning of yarn of the type comprising two bodies of rotation each defining a surface and arranged such that in an operating position the surfaces are closely adjacent at a line of closest approach so as to define between them at that line a yarn formation area, suction means for developing an airstream through at least one of the surfaces at the yarn formation area, a fibre feed duct for feeding fibres into the yarn formation area which feed duct terminates in the operating position closely adjacent the surfaces, the method comprising causing relative movement between at least one of the bodies and the duct in a direction transverse to the line and to increase the spacing therebetween, and temporarily halting the airstream through the surface.

12. A method according to claim 11, wherein the yarn formation area is elongate and wherein the airstream through the surface is gradually closed off from one end of the area toward the opposite end whereby to move any fibres remaining in the area toward the opposite end for ejection from the area.

13. Method of cleaning following a yarn break an apparatus for open-end spinning of yarn comprising a body having a perforated surface, means defining an elongate yarn formation area on the surface, suction means for developing an air stream through the surface at the yarn formation area, and a fibre feed duct for feeding fibres onto the yarn formation area, the method comprising closing off the airstream through the surface gradually from one end of the area toward the opposite end whereby to move any fibres remaining on the area toward the opposite end for ejection from the area.

* * * * *